US010983550B2

(12) United States Patent
Miyaoka et al.

(10) Patent No.: US 10,983,550 B2
(45) Date of Patent: Apr. 20, 2021

(54) ILLUMINATION SWITCH DEVICE

(71) Applicant: Panasonic Intellectual Property Management Co., Ltd., Osaka (JP)

(72) Inventors: Takeshi Miyaoka, Fukui (JP); Takuya Sasaki, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 94 days.

(21) Appl. No.: 16/276,211

(22) Filed: Feb. 14, 2019

(65) Prior Publication Data

US 2019/0179358 A1 Jun. 13, 2019

Related U.S. Application Data

(63) Continuation of application No. PCT/JP2017/014333, filed on Apr. 6, 2017.

(30) Foreign Application Priority Data

Aug. 25, 2016 (JP) ..... JP2016-164758

(51) Int. Cl.
*G05G 25/00* (2006.01)
*H01H 13/02* (2006.01)
(Continued)

(52) U.S. Cl.
CPC ..... *G05G 25/00* (2013.01); *F21V 5/04* (2013.01); *G05G 1/02* (2013.01); *H01H 9/16* (2013.01);
(Continued)

(58) Field of Classification Search
CPC ..... F21V 5/04; F21W 2111/00; H01H 13/02; H01H 13/023; H01H 13/83;
(Continued)

(56) References Cited

U.S. PATENT DOCUMENTS

2008/0001549 A1* 1/2008 Altonen ..... G02B 6/0001 315/250
2008/0151539 A1* 6/2008 Lee ..... G02B 6/0088 362/231
(Continued)

FOREIGN PATENT DOCUMENTS

CN 204905095 U 12/2015
JP 11-162280 A 6/1999
(Continued)

OTHER PUBLICATIONS

English Machine Translation of JP 2008218137 (Year: 2008).*
(Continued)

*Primary Examiner* — Zheng Song
(74) *Attorney, Agent, or Firm* — Seed IP Law Group LLP

(57) ABSTRACT

An illumination switch device includes a push button, a plurality of indicator lenses, a holder, a detector, a plurality of light emitters, and a base. The push button has an internal space and an opening. Each indicator lens has a columnar shape. The indicator lenses are juxtaposed in the internal space of the push button. The holder holds the push button such that the push button is movable in a longitudinal direction of each indicator lens. The detector detects a displacement of the push button in the longitudinal direction. The light emitters are respectively disposed opposite one ends of the indicator lenses in the longitudinal direction. The base is made of an opaque resin, and covers side faces of the indicator lenses while being in tight contact with the side faces. The base is integrated with the indicator lenses.

10 Claims, 3 Drawing Sheets

(51) Int. Cl.

| | |
|---|---|
| ***H01H 9/16*** | (2006.01) |
| ***F21V 5/04*** | (2006.01) |
| ***G05G 1/02*** | (2006.01) |
| *F21W 111/00* | (2006.01) |

(52) U.S. Cl.
CPC ..... *H01H 13/02* (2013.01); *F21W 2111/00* (2013.01)

(58) Field of Classification Search
CPC ..... H01H 2219/062; H01H 9/16; G05G 1/02; G05G 25/00
See application file for complete search history.

(56) References Cited

U.S. PATENT DOCUMENTS

| | | | | |
|---|---|---|---|---|
| 2012/0195062 | A1* | 8/2012 | Kosemura | H01H 13/83 362/581 |
| 2018/0056788 | A1* | 3/2018 | Boron | H03K 17/9622 |

FOREIGN PATENT DOCUMENTS

| | | | | |
|---|---|---|---|---|
| JP | 2008-192407 A | | 8/2008 | |
| JP | 2008-218137 A | | 9/2008 | |
| WO | WO 2009101719 | * | 8/2009 | H01H 13/023 |
| WO | WO 2014102466 | * | 7/2014 | B60K 37/06 |

OTHER PUBLICATIONS

English Translation of Chinese Search Report dated Sep. 3, 2019 for the related Chinese Patent Application No. 201780051641.1.
English Translation of the First Office Action dated Sep. 3, 2019 for the related Chinese Patent Application No. 201780051641.1.
English translation of the cited portion in D2.
International Search Report of PCT application No. PCT/JP2017/014333 dated Jul. 11, 2017.

* cited by examiner

ILLUMINATION SWITCH DEVICE

CROSS-REFERENCE TO RELATED APPLICATIONS

This application is a continuation of the PCT International Application No. PCT/JP2017/014333 filed on Apr. 6, 2017, which claims the benefit of foreign priority of Japanese patent application No. 2016-164758 filed on Aug. 15, 2016, the contents all of which are incorporated herein by reference.

TECHNICAL FIELD

The present invention relates to an illumination switch device including: a plurality of indicator lenses; a plurality of light emitters respectively disposed opposite one ends of the indicator lenses; and a push button and a holder in which the indicator lenses and the light emitters are accommodated.

BACKGROUND ART

An indicator-equipped, lighted push button switch disclosed in, for example, PTL 1 has been known as a conventional illumination switch device. In this push button switch, an operating knob is accommodated in an opening of a housing. A slider and a partition plate are joined to the operating knob. An indicator lens is disposed in the operating knob to guide light to a lighted indicator part. The indicator lens has a distal end inserted into a hole of the operating knob. The indicator lens also has a proximal end inserted between the slider and the partition plate. A light emitting diode is disposed opposite a rear end face of the indicator lens at a position between the slider and the partition plate. A light blocking wall is also disposed. The slider and the partition plate are interposed between the light blocking wall and a peripheral face of a holder holding the light emitting diode.

CITATION LIST

Patent Literature

PTL 1: Unexamined Japanese Patent Publication No. H11-162280

SUMMARY OF THE INVENTION

The present invention provides an illumination switch device that prevents unintentional light leakage and achieves size reduction.

An illumination switch device according to an aspect of the present invention includes a push button, a plurality of indicator lenses, a holder, a detector, a plurality of light emitters, and a base. The push button has an internal space and an opening. Each indicator lens has a columnar shape. The indicator lenses are juxtaposed in the internal space of the push button. The holder holds the push button such that the push button is movable in a longitudinal direction of each indicator lens. The detector detects a displacement of the push button in the longitudinal direction. The light emitters are respectively disposed opposite one ends of the indicator lenses in the longitudinal direction. The base is made of an opaque resin, and covers side faces of the indicator lenses while being in tight contact with the side faces. The base is integrated with the indicator lenses.

According to this exemplary embodiment, no clearance is defined between the base and each indicator lens. This exemplary embodiment therefore prevents unintentional leakage of light from each light emitter through such a clearance, and achieves size reduction of the illumination switch device.

In the illumination switch device, the one end of each indicator lens may have a width-narrowed portion. Each width-narrowed portion is narrower than a portion except the width-narrowed portion in a width as seen in a section perpendicular to the longitudinal direction of each indicator lens. The base may cover the side faces in the width-narrowed portions. The illumination switch device may further include a light blocking wall disposed between adjoining two of the light emitters. The light blocking wall has one end located beside the width-narrowed portions.

According to this exemplary embodiment, the light blocking wall is located between adjoining two of the width-narrowed portions. This exemplary embodiment therefore decreases a distance between adjoining two of the indicator lenses, and achieves size reduction of the illumination switch device.

In the illumination switch device, the indicator lenses may define adjoining two spaces filled with the base.

According to this exemplary embodiment, the base bonds the plurality of indicator lenses together. This exemplary embodiment therefore eliminates the necessity of work to mount the plurality of indicator lenses to the base, which is excellent in working efficiency.

The present invention provides an illumination switch device that prevents unintentional light leakage and achieves size reduction.

The objects, features, and advantages of the present invention will become apparent from the following detailed description of a preferred exemplary embodiment with reference to the accompanying drawings.

DESCRIPTION OF EMBODIMENTS

Prior to a description on an exemplary embodiment of the present invention, a brief description will be given of the related art. In the push button switch disclosed in PTL 1, the indicator lens and the slider are partially engaged with each other; however, no connection is established between the indicator lens and the partition plate. Therefore, a minute gap is inevitably created between the indicator lens and each of the slider and the partition plate. This clearance occasionally causes light from the light emitting diode to leak out of the push button switch through the hole in the operating knob.

Another push button switch includes a plurality of indicator lenses that are juxtaposed. This push button switch is upsized due to a plurality of clearances between the indicator lenses and each of a slider and a partition plate.

Hereinafter, a detailed description will be given of an exemplary embodiment of the present invention with reference to the drawings. In the following description, identical or corresponding elements depicted in all the drawings are denoted with identical reference marks; therefore, the duplicate description thereof will not be given here. For the sake of description, an upper side corresponds to a side closer to a push button than a casing is, and a lower side corresponds to a side closer to the casing than the push button is. In addition, a direction from the lower side to the upper side is referred to as a perpendicular direction. However, an illumination switch device may be installed in any orientation. For example, the push button is not necessarily located above the casing.

First Exemplary Embodiment

Figure 1:
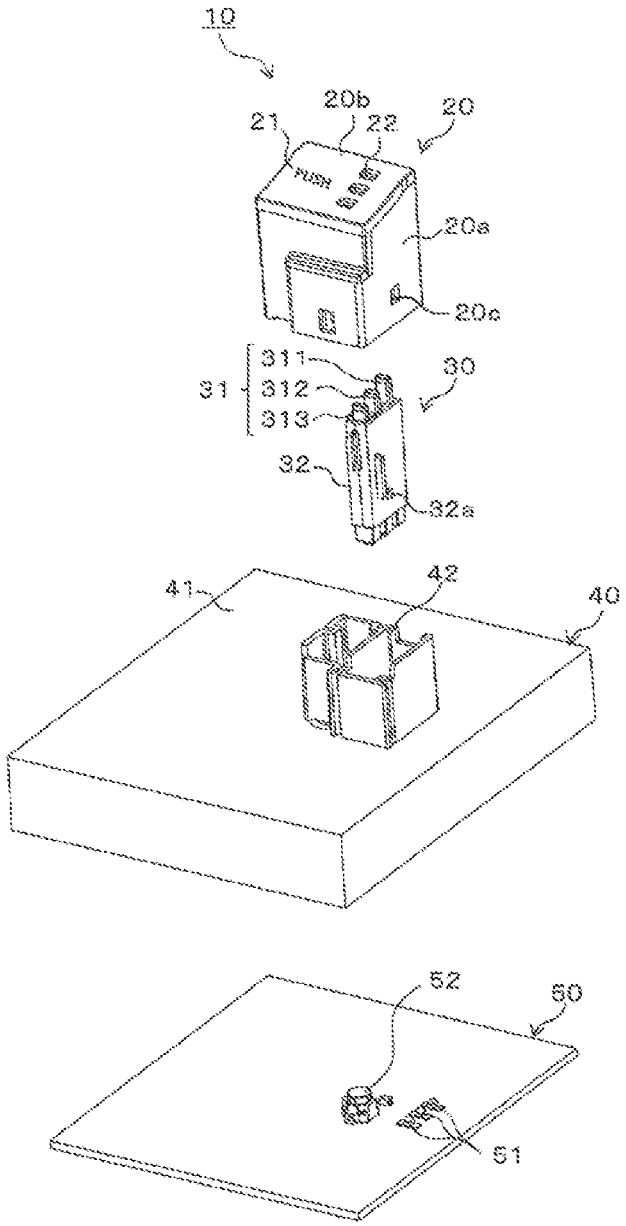
FIG. 1 is an exploded perspective view of an illumination switch device according to a first exemplary embodiment of the present invention.

With reference to FIG. 1, first, a description will be given of illumination switch device 10 according to a first exemplary embodiment. Illumination switch device 10 is a push button switch in which display part 21 and indication part 22 are lighted to display and indicate, for example, an operating state of an apparatus such as a seat heater or an air conditioning system. Illumination switch device 10 includes push button 20, indicator unit 30, casing 40, and printed circuit board 50.

Push button 20 is a component to be operated by a user, and has an internal space and an opening. For example, push button 20 has a box shape and includes sidewall 20*a* having a tubular shape, and upper wall 20*b* covering one of openings of sidewall 20*a*. Display part 21 and one or more (three in this exemplary embodiment) indication parts 22 are disposed on upper wall 20*b*. Display part 21 displays a design indicative of an operation such as PUSH or a function of the apparatus. Indication parts 22 indicate operating states of the apparatus, such as ON/OFF states or an operative one of a plurality of stages. Sidewall 20*a* has one or more lock holes 20*c* for fixing push button 20 to indicator unit 30.

Indicator unit 30 is disposed in the internal space of push button 20. Indicator unit 30 includes a plurality (e.g., three in this exemplary embodiment) of indicator lenses 31. Indicator unit 30 also includes base 32. Three indicator lenses 31 each have a columnar shape. In addition, three indicator lenses 31 are light guide parts configured to respectively guide light from a plurality of light emitters 51 on printed circuit board 50 into indication parts 22 of push button 20. In this exemplary embodiment, three indicator lenses 31 are juxtaposed in push button 20. In this exemplary embodiment, specifically, three indicator lenses 31 are arranged such that their longer axes (longitudinal axes) are parallel with one another and are present within the same plane. Three indicator lenses 31 include first indicator lens 311, second indicator lens 312, and third indicator lens 313. Second indicator lens 312 is disposed between first indicator lens 311 and third indicator lens 313 in a juxtaposition direction of three indicator lenses 31. The juxtaposition direction used in this exemplary embodiment refers to a direction perpendicular to the longer axes of three indicator lenses 31 in a plane where the longer axes of three indicator lenses 31 parallel with one another are present. It should be noted that first indicator lens 311, second indicator lens 312, and third indicator lens 313 are collectively referred to as indicator lenses 31 as long as they are not necessarily distinguished from one another.

Base 32 holds the plurality of indicator lenses 31 and blocks light to indicator lenses 31. Base 32 covers side faces of indicator lenses 31 while being in tight contact with the side faces. In addition, base 32 is integrated with indicator lenses 31 such that a space between indicator lenses 31 is filled with base 32. Specifically, base 32 and indicator lenses 31 are formed by double molding. This configuration enables enhanced tight contact of base 32 with the plurality of indicator lenses 31.

Casing 40 serves as a foundation for push button 20, and includes main body 41 and holder 42. Main body 41 has, for example, a flat plate shape, and holder 42 is disposed on an upper face of main body 41. Holder 42 holds push button 20 such that push button 20 is movable in a longitudinal direction of each indicator lens 31 (i.e., a heightwise direction in this exemplary embodiment). For example, holder 42 has a tubular shape. Holder 42 has an upper open end and a lower open end.

Printed circuit board 50 includes electronic circuits (not illustrated). Printed circuit board 50 has a plate shape, and electronic components such as light emitters 51 and switch 52 are mounted on a surface of printed circuit board 50. The electronic components are interconnected by a wiring pattern. Light emitters 51 are light sources configured to respectively light indication parts 22. The plurality (three in this exemplary embodiment) of light emitters 51 are respectively disposed opposite one ends of indicator lenses 31 in the longitudinal direction. Switch 52 is a detector configured to detect a displacement of push button 20 in the longitudinal direction. Switch 52 is configured to open and close the electronic circuits to which light emitters 51 are connected. For example, switch 52 is disposed opposite a protrusion (not illustrated) on a lower end of push button 20. When a user operates push button 20, the protrusion pushes switch 52, so that switch 52 opens or closes the electronic circuits.

Figure 2:
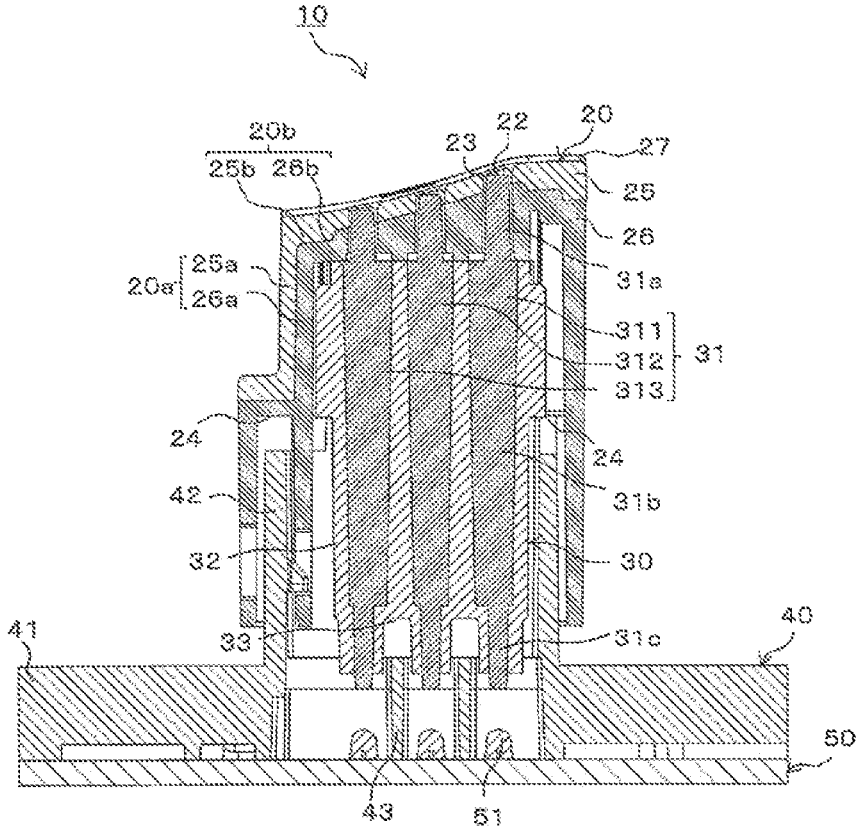
FIG. 2 is a sectional view of the illumination switch device illustrated in FIG. 1.

With reference to FIG. 2, next, a specific description will be given of the respective elements. Upper wall 20*b* of push button 20 has a plurality (three in this exemplary embodiment) of holes 23. Holes 23 extend from an outer surface to an inner surface of upper wall 20*b*. Sidewall 20*a* of push button 20 partially or entirely has groove 24. Groove 24 is formed upward from a lower face of sidewall 20*a* so as to extend in the heightwise direction.

Push button 20 has, for example, a double-layer structure, that is, includes first layer 25 and second layer 26. First layer 25 is located outside second layer 26. First layer 25 constitutes the outer surface of push button 20, and second layer 26 constitutes the inner surface of push button 20. Alternatively, second layer 26 may constitute a part of the outer surface of push button 20.

First layer 25 includes first sidewall 25*a* and first upper wall 25*b*. Second layer 26 includes second sidewall 26*a* and second upper wall 26*b*. First upper wall 25*b* is superimposed on second upper wall 26*b*, so that first upper wall 25*b* and second upper wall 26*b* constitute upper wall 20*b* of push button 20. First sidewall 25*a* covers an outer periphery of second sidewall 26*a*, so that first sidewall 25*a* and second sidewall 26*a* constitute sidewall 20*a* of push button 20. However, first sidewall 25*a* may partially cover the outer periphery of second sidewall 26*a*.

First layer 25 is made of a light transmissive material. Examples of the light transmissive material may include white resins such as polycarbonate. Upper wall 20*b* of first layer 25 has a surface coated with black surface coat 27 except display part 21 (see FIG. 1), for example. Thus, display part 21 displays, for example, PUSH on the outer surface of push button 20.

Second layer 26 is made of an opaque material. Examples of the opaque material may include black resins such as polycarbonate.

Indicator lenses 31 are each made of a light transmissive material. Examples of the light transmissive material may include transparent resins and approximately transparent resins such as acryl resin and polycarbonate. Indicator lenses 31 are juxtaposed and spaced apart from one another such that the longer axes extend in parallel with one another. Indicator lenses 31 extend in the heightwise direction. In other words, the longer axes of indicator lenses 31 are oriented in the heightwise direction. Indicator lenses 31 each include upper portion 31*a*, lower portion 31*c*, and middle portion 31*b* between upper portion 31*a* and lower portion 31*c*.

Upper portions 31*a* each have a columnar shape such as a prismatic shape or a cylindrical shape, and are inserted into holes 23 of push button 20. Upper portions 31*a* have upper faces protruding from holes 23 to function as indication parts 22. Upper portions 31*a* are narrower in width than middle portions 31*b* in the juxtaposition direction. Alternatively, upper portions 31*a* may be equal in width to middle portions 31*b* in the juxtaposition direction. In addition, upper portions 31*a* are equal in width to or narrower in width than middle portions 31*b* in a direction orthogonal to the juxtaposition direction and the longer-axis direction. Moreover, the width of each upper portion 31*a* in the juxtaposition direction may gradually increase downward for ease of release from a die in manufacturing indicator unit 30. In addition, the width of each upper portion 31*a* in the direction orthogonal to the juxtaposition direction and the longer-axis direction may gradually increase downward for ease of release from a die in manufacturing indicator unit 30.

Lower portions 31*c* are each a width-narrowed portion of which the width is narrowed in the juxtaposition direction. Lower portions 31*c* each have a columnar shape such as a prismatic shape or a cylindrical shape. Lower portions 31*c* are dented from middle portions 31*b* in the juxtaposition direction. In other words, lower portions 31*c* are narrower in width than middle portions 31*b* (i.e., portions except lower portions 31*c*) in the juxtaposition direction. These dents are created to increase a distance between adjoining two of lower portions 31*c*.

More specifically, lower portions 31*c* each have a first dent and a second dent located opposite the first dent so as to face a corresponding one of lower portions 31*c* in the juxtaposition direction. Of the two dents, the first dent faces indicator lens 31 adjoining thereto. If the second dent faces no indicator lens 31, the first dent is dented greater than the second dent. In this case, lower portions 31*c* are respectively located away from indicator lenses 31 adjoining thereto in the juxtaposition direction, so that the distance between adjoining two of lower portions 31*c* increases. The longer axes of lower portions 31*c* are each located to be distanced from indicator lens 31 adjoining thereto, with respect to the longer axes of middle portions 31*b* in the juxtaposition direction. For example, the longer axes of lower portions 31*c* are aligned with the longer axes of upper portions 31*a*. It should be noted that each dent may face indicator lens 31 adjoining thereto, with members including base 32 and light blocking wall 43 interposed between each dent and adjoining indicator lens 31.

In each of first indicator lens 311 and third indicator lens 313, the first dent faces second indicator lens 312 while the second dent faces no indicator lens 31. In this case, the first dent facing second indicator lens 312 is deeper in depth than the second dent. This configuration thus increases a distance between first indicator lens 311 and second indicator lens 312 and a distance between third indicator lens 313 and second indicator lens 312.

The two dents respectively facing indicator lenses 31 adjoining thereto are equal in depth to each other. In this case, lower portion 31*c* is located at a center of middle portion 31*b* in the juxtaposition direction. The axis of lower portion 31*c* is aligned with the axis of middle portion 31*b* and the axis of upper portion 31*a* in the juxtaposition direction, for example.

In, for example, second indicator lens 312, the first dent faces first indicator lens 311, and the second end faces third indicator lens 313. In this case, the first dent facing first indicator lens 311 is equal in depth to the second dent facing third indicator lens 313.

Lower portions 31*c* are equal in width to or narrower in width than middle portions 31*b* in the direction orthogonal to the juxtaposition direction and the longer-axis direction. Moreover, the width of each lower portion 31*c* in the juxtaposition direction may gradually decrease downward for ease of release from a die in manufacturing indicator unit 30. In addition, the width of each lower portion 31*c* in the direction orthogonal to the juxtaposition direction and the longer-axis direction may gradually decrease downward for ease of release from a die in manufacturing indicator unit 30.

Middle portions 31*b* each have a columnar shape such as a prismatic shape or a cylindrical shape, and extend in the direction orthogonal to the juxtaposition direction and the longer-axis direction so as to be longer than upper portions 31*a* and lower portions 31*c* in the heightwise direction. Moreover, the width of each middle portion 31*b* in the juxtaposition direction may gradually decrease downward for ease of release from a die in manufacturing indicator unit 30. In addition, the width of each middle portion 31*b* in the direction orthogonal to the juxtaposition direction and the longer-axis direction may gradually decrease downward for ease of release from a die in manufacturing indicator unit 30.

Base 32 is made of an opaque material. Examples of the opaque material may include black resins such as ABS resin. Base 32 has a rectangular parallelepiped shape. Base 32 has on its side face one or more engagement projections 32*a* that are fitted into the internal space of push button 20. At this time, base 32 is fixed to push button 20 in such a manner that engagement projections 32*a* are engaged with corresponding lock holes 20*c* of push button 20. It should be noted that base 32 may have any shape in addition to a rectangular parallelepiped shape. In addition to the engagement of engagement projections 32*a* with lock holes 20*c*, base 32 may be fixed to push button 20 by any known bonding method such as engagement using snap-fitting, press fitting, or an adhesive.

A gap is created between the side face of base 32 and sidewall 20*a* of push button 20. This gap is connected to groove 24 in sidewall 20*a* of push button 20. A part of the gap functions as groove 24. Thus, indicator unit 30 is surrounded with groove 24.

The plurality (three in this exemplary embodiment) of indicator lenses 31 are disposed in base 32, and the side faces of indicator lenses 31 are covered with base 32. Indicator lenses 31 are integrated with base 32 such that no clearance is defined between each indicator lens 31 and base 32.

Upper portions 31*a* of indicator lenses 31 protrude upward from an upper face of base 32. Lower portions 31*c* of indicator lenses 31 partially protrude downward from a lower face of base 32. Alternatively, the lower portions 31*c* may have lower faces made flush with the lower face of base 32 without partially protruding downward from the lower face of base 32.

Base 32 has one or more (two in this exemplary embodiment) recesses 33. Each recess 33 is recessed upward from the lower face of base 32, and is disposed between adjoining two of indicator lenses 31. Recesses 33 have bottoms located below upper ends of lower portions 31*c* and lower ends of middle portions 31*b* in indicator lenses 31. Thus, recesses 33 located below middle portions 31*b* are each located between adjoining two of lower portions 31*c*.

Casing 40 is disposed on printed circuit board 50. Holder 42 of casing 40 is a tubular wall extending in the heightwise direction. Holder 42 is inserted into groove 24 in sidewall 20*a* of push button 20. Holder 42 is also inserted into groove 24 between base 32 and sidewall 20*a* of push button 20. Thus, push button 20 is held by holder 42. In addition, groove 24 slides along holder 42, so that push button 20 is movable relative to holder 42 in the heightwise direction. Indicator unit 30 is accommodated in a space defined by push button 20 and holder 42.

Casing 40 is provided with light blocking walls 43 each disposed between adjoining two of light emitters 51. Light blocking walls 43 prevent light from light emitters 51 disposed opposite the lower faces of indicator lenses 31, from entering different indicator lenses 31. Light blocking walls 43 extend upward from printed circuit board 50, and are inserted into recesses 33 of base 32.

The height of each light blocking wall 43 is set such that base 32 and light blocking walls 43, which always surround recesses 33, overlap each other as seen in the juxtaposition direction, irrespective of the heightwise movement of push button 20. Thus, light blocking walls 43 have upper ends (distal ends) located beside lower portions 31*c* (width-narrowed portions) and located between upper and lower ends of lower portions 31*c* (width-narrowed portions).

Light emitters 51 are, for example, light emitting diodes (LEDs), and are disposed to face the lower faces of indicator lenses 31. Each light blocking wall 43 is disposed between adjoining two of indicator lenses 31. Light blocking walls 43 have lower ends that are in contact with printed circuit board 50. Thus, each light blocking wall 43 and base 32 interrupt between adjoining two of light emitters 51.

Figure 3A:
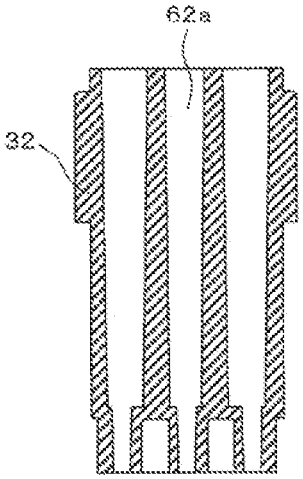
FIG. 3A is a schematic sectional view of a base.
Figure 3B:
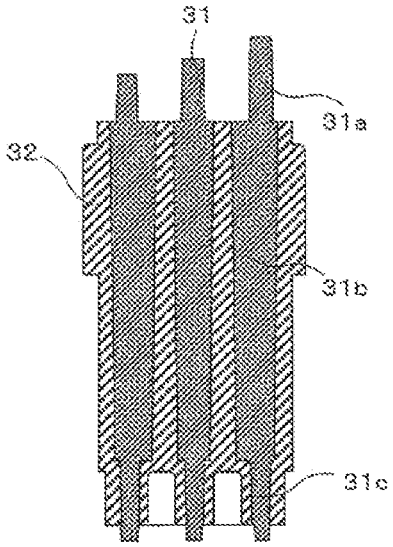
FIG. 3B is a schematic sectional view of an indicator unit that includes the base in FIG. 3A and an indicator lens each formed by double molding.

With reference to FIGS. 3A and 3B, next, a description will be given of a method for manufacturing indicator unit 30. As illustrated in FIG. 3A, first, base 32 having three through holes 62*a* is formed by, for example, resin molding such as injection molding using an opaque resin. Next, indicator lenses 31 are formed in through holes 62*a* of base 32 such that upper portions 31*a* and lower portions 31*c* respectively protrude from through holes 62*a*, by double molding using a light transmissive resin. Thus, base 32 covers indicator lenses 31 such that a clearance between adjoining two of indicator lenses 31 is filled with base 32.

As described above, when base 32 and indicator lenses 31 are formed by double molding, indicator unit 30 in which base 32 is integrated with indicator lenses 31 is formed. Thus, no clearance is defined between base 32 and the side face of each indicator lens 31 covered with base 32.

Next, a description will be given of the use of illumination switch device 10. When a user pushes push button 20, push button 20 moves downward while being held by holder 42. With this downward movement, the protrusion of push button 20 pushes switch 52, so that switch 52 opens or closes the electronic circuits. Thus, light emitter 51 connected to a closed one of the electronic circuits emits light. This light enters the lower face of a corresponding one of indicator lenses 31, passes through indicator lens 31 from lower portion 31*c* to upper portion 31*a* via middle portion 31*b*, and then goes out of the upper face of indicator lens 31. Thus, a corresponding one of indication parts 22 is lighted.

As described above, according to illumination switch device 10, light blocking walls 43 are disposed between light emitters 51 and the lower faces of indicator lenses 31 in the perpendicular direction. Light blocking walls 43 overlap base 32 as seen in the juxtaposition direction. Therefore, light blocking walls 43 prevent light emitted from light emitters 51, from entering neighboring indicator lenses 31.

In addition, since no clearance is defined between base 32 and each indicator lens 31, light guided to each indicator lens 31 never leaks through such a clearance. This configuration eliminates the following measures for blocking light leaking through a clearance. Specifically, it is unnecessary to make upper portions 31*a* smaller in size than middle portions 31*b* in the direction orthogonal to the heightwise direction (i.e., the juxtaposition direction as well as the direction orthogonal to the juxtaposition direction and the longer-axis direction), to dispose each upper portion 31*a* at the center of corresponding middle portion 31*b*, and to close a clearance with upper wall 20*b* of push button 20. Therefore, the size and position of each upper portion 31*a* in push button 20 are set freely within a range of corresponding middle portion 31*b*.

Base 32 covers the side faces of indicator lenses 31 while being in tight contact with the side faces. In addition, base 32 is integrated with indicator lenses 31. Therefore, no clearance is defined between base 32 and each indicator lens 31, which leads to size reduction of indicator unit 30, in turn, illumination switch device 10.

Since no clearance is defined between base 32 and each indicator lens 31, the height of each light blocking wall 43 is made lower. Thus, the thickness of each light blocking wall 43 in the juxtaposition direction is made smaller, which also leads to size reduction of indicator unit 30, in turn, illumination switch device 10.

In addition, base 32 covers indicator lenses 31 such that a clearance between adjoining two of indicator lenses 31 is filled with base 32. This configuration eliminates the necessity of covering members for covering indicator lenses 31 and also eliminates the necessity of a distance between adjoining two of the covering members, which also leads to size reduction of indicator unit 30, in turn, illumination switch device 10.

In addition, lower portion 31*c* of each indicator lens 31 is provided as a width-narrowed portion, and each light blocking wall 43 is inserted in corresponding recess 33 between adjoining two of lower portions 31*c*. This configuration therefore enables a decreased distance between adjoining two of indicator lenses 31, which also leads to size reduction of indicator unit 30, in turn, illumination switch device 10.

In addition, the plurality of indicator lenses 31 are simultaneously formed by double molding, and indicator unit 30 including base 32 integrated with the plurality of indicator lenses 31 is also formed by double molding. This configuration therefore eliminates the necessity of work to mount the plurality of indicator lenses 31 to base 32, which is excellent in working efficiency.

It is apparent from the foregoing description that those skilled in the art will conceive various modifications and other exemplary embodiments on the present invention. It is accordingly understood that the foregoing description is merely interpreted as being illustrative and is given for the purpose of teaching those skilled in the art the best mode for carrying out the present invention. It is therefore possible to substantially change the details of at least one of the structure and function of the present invention without departing from the spirit of the present invention.

INDUSTRIAL APPLICABILITY

An illumination switch device according to the present invention is useful as, for example, an illumination switch device that prevents unintentional light leakage and achieves size reduction.

REFERENCE MARKS IN THE DRAWINGS

10 illumination switch device
20 push button
20*a* sidewall
20*b* upper wall
20*c* lock hole
21 display part
22 indication part
23 hole
24 groove
25 first layer
25*a* first sidewall
25*b* first upper wall
26 second layer
26*a* second sidewall
26*b* second upper wall
27 surface coat
30 indicator unit
31 indicator lens (plurality of indicator lenses)
31*a* upper portion
31*b* middle portion
31*c* lower portion (width-narrowed portion)
311 first indicator lens
312 second indicator lens
313 third indicator lens
32 base
32*a* engagement projection
33 recess
40 casing
41 main body
42 holder
43 light blocking wall
50 printed circuit board
51 light emitter (plurality of light emitters)
52 switch (detector)
62*a* through hole

The invention claimed is:

1. An illumination switch device comprising:
a push button having an internal space and an opening;
a plurality of indicator lenses each having linear columnar shape and a first end, the indicator lenses being juxtaposed in the internal space of the push button such that longer axes of the indicator lenses are parallel with one another, each of the plurality of indicator lenses including:
a first width-narrowed portion at the first end having a first width; and
a second portion coupled to the first width-narrowed portion, the second portion having a second width greater than the first width;
a holder configured to hold the push button, the push button being movable in a longitudinal direction of each indicator lens;
a detector configured to detect a displacement of the push button in the longitudinal direction;
a plurality of light emitters respectively disposed opposite the first ends of the indicator lenses in the longitudinal direction; and
a base including an opaque resin, the base covering all side faces of the second portions of the indicator lenses and being on all side faces of the first width-narrowed portions, the base being in tight contact with all of the side faces of the first width-narrowed portions and the second portions, parts of the first width-narrowed portions being exposed from the base, and the base being integrated with the indicator lenses.

2. The illumination switch device according to claim 1, further comprising a light blocking wall disposed between two of the light emitters, the light blocking walls having one end located beside the first width-narrowed portions.

3. The illumination switch device according to claim 2, wherein one of the plurality of indicator lenses includes:
a first dent on a first side of the one of the plurality of indicator lenses, the first dent extending from the second portion to the first width-narrowed portion; and
a second dent on a second side of the one of the plurality of indicator lenses, the second side being opposite to the first side, the second dent extending from the second portion to the first width-narrowed portion,
wherein the first dent is deeper than the second dent in a direction extending from one of the side faces of the second portion to one of the side faces of the first width-narrowed portion, the first dent facing an adjoining indicator lens of the plurality of indicator lenses, and the second dent facing away from the adjoining indicator lens of the plurality of indicator lenses.

4. The illumination switch device according to claim 3, wherein another one of the plurality of indicator lenses includes:
a first dent on a first side of the another one of the plurality of indicator lenses, the first dent extending from the second portion to the first-width narrowed portion; and
a second dent on a second side of the another one of the plurality of lenses, the second side being opposite to the first side, the second dent extending from the second portion to the first-width narrowed portion,
wherein the first dent has a first depth and the second dent has a second depth, the first and second depths extending in a direction from one of the side faces of the second portion to one of the side faces of the first width-narrowed portion, the first depth being the same as the second depth, and both of the first and second dents facing adjoining indicator lenses of the plurality of indicator lenses.

5. The illumination switch device according to claim 2, wherein two spaces between the indicator lenses are filled with the base.

6. The illumination switch device according to claim 1, wherein two spaces between the indicator lenses are filled with the base.

7. An illumination switch device comprising:
a push button having an internal space and an opening;
a plurality of indicator lenses each having a linear columnar shape, the plurality of indicator lenses including:
a first portion at a first end with a first width;
a second portion at a second end with a second width; and
a third portion extending from the first portion to the second portion, the third portion having a third width greater than the first width and the second width;

a holder configured to hold the push button, the push button being moveable in a longitudinal direction parallel to longer axes of the plurality of indicator lenses;

a plurality of light emitters, each one of the plurality of light emitters being aligned with at least one of the first portions at the first ends of the plurality of indicator lenses;

a base including a plurality of through holes, the plurality of indicator lenses are positioned within the plurality of through holes, the base is in tight contact with the plurality of indicator lenses.

8. The illumination switch device of claim 7, wherein the base covers side faces of the third portions of the plurality of indicator lenses and is on side faces of the first portions at the first ends of the plurality of indicator lenses.

9. The illumination switch device of claim 8, wherein parts of the first portions are exposed from the base.

10. The illumination switch device of claim 7, wherein the third widths of the third portions gradually decrease in a direction directed from the second portion to the first portion.

* * * * *